US010869128B2

(12) United States Patent
Qian et al.

(10) Patent No.: US 10,869,128 B2
(45) Date of Patent: Dec. 15, 2020

(54) MODULAR SPEAKER SYSTEM

(71) Applicant: Pangissimo, LLC, Boston, MA (US)

(72) Inventors: Juncheng Qian, Boston, MA (US); Constantine Hartofilis, Syosset, NY (US); Parsa Shahidi, West Dover, MA (US); Esiri Madagwa, West Hempstead, NY (US)

(73) Assignee: Pangissimo LLC, Boston, MA (US)

( * ) Notice: Subject to any disclaimer, the term of this patent is extended or adjusted under 35 U.S.C. 154(b) by 9 days.

(21) Appl. No.: 16/534,769

(22) Filed: Aug. 7, 2019

(65) Prior Publication Data

US 2020/0053462 A1 Feb. 13, 2020

Related U.S. Application Data

(60) Provisional application No. 62/715,750, filed on Aug. 7, 2018.

(51) Int. Cl.

| | |
|---|---|
| ***H04R 5/02*** | (2006.01) |
| ***H04R 1/02*** | (2006.01) |
| ***H04R 3/12*** | (2006.01) |
| ***H04R 1/40*** | (2006.01) |
| ***H04S 3/00*** | (2006.01) |

(52) U.S. Cl.

CPC ..... *H04R 5/02* (2013.01); *H04R 1/025* (2013.01); *H04R 1/026* (2013.01); *H04R 1/403* (2013.01); *H04R 3/12* (2013.01); *H04S 3/008* (2013.01); *H04R 2420/07* (2013.01); *H04S 2400/01* (2013.01)

(58) Field of Classification Search

CPC . H04R 5/02; H04R 3/12; H04R 3/008; H04R 3/00; H04R 1/026; H04R 1/025; H04R 2400/01; H04R 2400/03; H04R 2420/07

See application file for complete search history.

(56) References Cited

U.S. PATENT DOCUMENTS

| | | | |
|---|---|---|---|
| 5,386,478 | A | 1/1995 | Plunkett |
| 5,400,405 | A | 3/1995 | Petroff |
| 5,581,626 | A | 12/1996 | Palmer |
| 5,602,366 | A | 2/1997 | Whelan et al. |
| 5,742,696 | A | 4/1998 | Walton |
| 5,986,498 | A | 11/1999 | Rodriguez |

(Continued)

OTHER PUBLICATIONS

International Search Report for PCT/US2019/045572, dated Nov. 14, 2019, 2 pages.

(Continued)

*Primary Examiner* — Yogeshkumar Patel
(74) *Attorney, Agent, or Firm* — Goodwin Procter LLP

(57) ABSTRACT

Described herein are modular speaker systems including a plurality of wireless speaker modules configured to output sound in a first arrangement and in a second arrangement, in which the first arrangement is different from the second arrangement. In the first arrangement, at least one speaker module can be in physical contact with at least one other speaker module. In the second arrangement, the at least one speaker module can be physically separated from the at least one other speaker module. The plurality of wireless speaker modules may be arranged in any orientation with respect to one another.

27 Claims, 11 Drawing Sheets

(56) References Cited

U.S. PATENT DOCUMENTS 6,002,780 A 12/1999 Espiritu
6,038,323 A 3/2000 Petroff
6,224,801 B1 5/2001 Mango, III
6,263,084 B1 7/2001 Cressman et al.
D451,087 S 11/2001 Moro et al.
6,327,372 B1 12/2001 Devantier et al.
6,373,957 B1 4/2002 Stewart
6,392,476 B1 5/2002 Rodriguez
6,404,897 B1 6/2002 Devantier et al.
D460,064 S 7/2002 Solland
D460,959 S 7/2002 Solland
D461,178 S 8/2002 Solland
D462,067 S 8/2002 Solland
D462,068 S 8/2002 Solland
D464,334 S 10/2002 Solland
D465,778 S 11/2002 Solland
D465,779 S 11/2002 Solland
D466,494 S 12/2002 Solland
D467,241 S 12/2002 Solland
D467,575 S 12/2002 Solland
D467,576 S 12/2002 Solland
D467,900 S 12/2002 Solland
D467,901 S 12/2002 Solland
D467,902 S 12/2002 Solland
D467,903 S 12/2002 Solland
D467,904 S 12/2002 Solland
D468,291 S 1/2003 Solland
D468,293 S 1/2003 Solland
D468,294 S 1/2003 Solland
D468,295 S 1/2003 Solland
D468,298 S 1/2003 Solland
D469,425 S 1/2003 Solland
6,505,705 B1 1/2003 Espiritu et al.
D470,475 S 2/2003 Solland
D470,476 S 2/2003 Solland
D471,530 S 3/2003 Solland
D471,531 S 3/2003 Solland
D471,532 S 3/2003 Solland
D471,888 S 3/2003 Solland
D471,896 S 3/2003 Solland
D471,897 S 3/2003 Solland
6,527,237 B2 3/2003 Harary et al.
D473,858 S 4/2003 Solland
D474,764 S 5/2003 Solland
D476,641 S 7/2003 Castro et al.
D478,566 S 8/2003 Solland
D478,567 S 8/2003 Solland
6,619,424 B2 9/2003 Manrique et al.
D480,382 S 10/2003 Solland
D483,743 S 12/2003 Vosse
D483,744 S 12/2003 Vosse
D484,113 S 12/2003 Solland
D484,486 S 12/2003 Solland
D484,487 S 12/2003 Solland
D484,488 S 12/2003 Solland
D484,491 S 12/2003 Solland
6,664,460 B1 12/2003 Pennock et al.
D484,869 S 1/2004 Solland
D484,870 S 1/2004 Solland
D484,871 S 1/2004 Solland
D485,544 S 1/2004 Solland
6,675,932 B2 1/2004 Manrique et al.
D488,147 S 4/2004 Solland
D494,959 S 8/2004 Williamson
D496,353 S 9/2004 Williamson
6,839,670 B1 1/2005 Stammler et al.
6,876,748 B1 4/2005 Petroff
6,891,957 B2 5/2005 Manrique et al.
6,991,289 B2 1/2006 House
6,996,239 B2 2/2006 Wood
7,016,509 B1 3/2006 Bharitkar et al.
7,026,539 B2 4/2006 Pennock et al.
7,039,196 B1 5/2006 Becker et al.
7,043,027 B2 5/2006 Wood
7,072,481 B2 7/2006 Button et al.
7,110,839 B2 9/2006 Wood
7,134,523 B2 11/2006 Engebretson
7,158,648 B2 1/2007 Butters et al.
7,254,378 B2 8/2007 Benz et al.
7,274,797 B2 9/2007 Hungerford
7,280,668 B2 10/2007 Devantier et al.
7,298,860 B2 11/2007 Engebretson et al.
7,321,661 B2 1/2008 Stanley
7,373,123 B2 5/2008 Spellman
7,373,210 B2 5/2008 Pennock et al.
7,438,155 B2 10/2008 Stead et al.
7,443,987 B2 10/2008 Griesinger
7,451,006 B2 11/2008 Eid et al.
7,466,832 B2 12/2008 House
7,516,932 B2 4/2009 Engebretson et al.
7,526,093 B2 4/2009 Devantier et al.
7,555,533 B2 6/2009 Hennecke
7,606,376 B2 10/2009 Eid et al.
7,693,714 B2 4/2010 Iser et al.
7,711,134 B2 5/2010 Stead et al.
7,761,204 B2 7/2010 Konig
7,792,311 B1 9/2010 Holmgren et al.
7,826,622 B2 11/2010 Keele, Jr.
7,840,018 B2 11/2010 Prenta et al.
7,889,871 B2 2/2011 Gierl et al.
7,953,239 B2 5/2011 Decanio
7,974,338 B2 7/2011 Becker et al.
7,995,785 B2 8/2011 Royse
8,031,879 B2 10/2011 Eid et al.
8,077,873 B2 12/2011 Shridhar et al.
8,090,112 B2 1/2012 Shuttleworth
8,094,865 B2 1/2012 Espiritu
8,135,162 B2 3/2012 Holt et al.
8,139,783 B2 3/2012 Schuster et al.
8,170,223 B2 5/2012 Keele, Jr.
8,170,263 B2 5/2012 Engebretson et al.
8,181,736 B2 5/2012 Sterling et al.
8,194,869 B2 6/2012 Mihelich et al.
8,199,924 B2 6/2012 Wertz et al.
8,270,626 B2 9/2012 Shridhar et al.
8,270,651 B2 9/2012 McCarty et al.
8,280,076 B2 10/2012 Devantier et al.
8,418,802 B2 4/2013 Sterling et al.
8,477,966 B2 7/2013 Prenta et al.
8,577,048 B2 11/2013 Chaikin et al.
D695,715 S 12/2013 Burlingame et al.
8,672,088 B2 3/2014 Sterling et al.
8,688,458 B2 4/2014 Buck et al.
8,718,289 B2 5/2014 Shridhar et al.
8,755,542 B2 6/2014 Devantier et al.
8,761,419 B2 6/2014 Devantier et al.
8,788,080 B1 7/2014 Kallai et al.
8,811,630 B2 8/2014 Burlingame
8,842,847 B2 9/2014 Geisler
8,867,761 B2 10/2014 Lazar et al.
8,923,997 B2 12/2014 Kallai et al.
D721,059 S 1/2015 Lehnert
8,929,579 B2 1/2015 Kalyuzhny et al.
8,938,312 B2 1/2015 Millington et al.
8,942,395 B2 1/2015 Lissaman et al.
8,948,441 B2 2/2015 Zhao
D724,570 S 3/2015 Kusano et al.
8,971,546 B2 3/2015 Millington et al.
8,983,112 B2 3/2015 Zhao
8,995,673 B2 3/2015 Mihelich et al.
9,008,330 B2 4/2015 Sheen et al.
9,014,411 B2 4/2015 Rodgers
9,014,834 B2 4/2015 Kallai et al.
9,020,158 B2 4/2015 Wertz et al.
9,031,255 B2 5/2015 Beckhardt et al.
9,042,556 B2 5/2015 Kallai et al.
9,100,766 B2 8/2015 Soulodre
9,106,996 B2 8/2015 Burgett et al.
9,113,244 B2 8/2015 Decanio
9,122,451 B2 9/2015 Calatayud
9,154,864 B1 10/2015 Sell
9,166,273 B2 10/2015 van Niekerk
9,182,777 B2 11/2015 Millington
9,188,449 B2 11/2015 Biswal et al.

(56) References Cited

U.S. PATENT DOCUMENTS

| | | | |
|---|---|---|---|
| 9,189,010 | B2 | 11/2015 | Millington |
| 9,191,721 | B2 | 11/2015 | Holladay et al. |
| D746,258 | S | 12/2015 | Lehnert |
| 9,207,905 | B2 | 12/2015 | Millington |
| 9,219,460 | B2 | 12/2015 | Bush |
| 9,219,959 | B2 | 12/2015 | Kallai et al. |
| 9,223,353 | B2 | 12/2015 | Calatayud et al. |
| 9,226,087 | B2 | 12/2015 | Ramos |
| 9,253,893 | B1 | 2/2016 | Buchheit |
| 9,264,839 | B2 | 2/2016 | Oishi et al. |
| 9,298,994 | B2 | 3/2016 | Marti et al. |
| 9,301,043 | B2 | 3/2016 | Moro |
| 9,317,458 | B2 | 4/2016 | Bushen et al. |
| 9,319,769 | B2 | 4/2016 | Burgett et al. |
| 9,323,404 | B2 | 4/2016 | Calatayud et al. |
| 9,327,645 | B2 | 5/2016 | Raman et al. |
| 9,344,829 | B2 | 5/2016 | Oishi et al. |
| 9,354,677 | B2 | 5/2016 | Reilly et al. |
| 9,356,571 | B2 | 5/2016 | Burgett |
| 9,374,607 | B2 | 6/2016 | Bates et al. |
| 9,386,365 | B2 | 7/2016 | Burgett et al. |
| 9,414,964 | B2 | 8/2016 | Censo et al. |
| 9,419,575 | B2 | 8/2016 | Bush |
| 9,432,791 | B2 | 8/2016 | Chatterjee |
| 9,439,021 | B2 | 9/2016 | Oishi et al. |
| 9,439,022 | B2 | 9/2016 | Oishi et al. |
| 9,446,559 | B2 | 9/2016 | Popken et al. |
| 9,451,724 | B2 | 9/2016 | Reilly et al. |
| 9,456,277 | B2 | 9/2016 | Burlingame |
| 9,460,631 | B2 | 10/2016 | Reilly et al. |
| 9,462,384 | B2 | 10/2016 | Lakkundi et al. |
| 9,469,247 | B2 | 10/2016 | Juneja et al. |
| 9,477,440 | B2 | 10/2016 | Calatayud |
| 9,481,326 | B2 | 11/2016 | Chatterjee |
| 9,503,819 | B2 | 11/2016 | Brockmole |
| 9,509,820 | B2 | 11/2016 | Gopinath |
| 9,516,419 | B2 | 12/2016 | Oishi et al. |
| 9,519,454 | B2 | 12/2016 | Reimann |
| 9,520,850 | B2 | 12/2016 | Lazar et al. |
| 9,521,212 | B2 | 12/2016 | Kumar et al. |
| 9,521,487 | B2 | 12/2016 | Oishi et al. |
| 9,521,488 | B2 | 12/2016 | Oishi et al. |
| 9,524,098 | B2 | 12/2016 | Griffiths et al. |
| 9,524,707 | B2 | 12/2016 | Urry et al. |
| 9,525,929 | B2 | 12/2016 | Burgett et al. |
| 9,525,931 | B2 | 12/2016 | Wiggins |
| 9,538,293 | B2 | 1/2017 | Danovi |
| 9,544,640 | B2 | 1/2017 | Lau |
| 9,544,679 | B2 | 1/2017 | Trestain et al. |
| 9,544,689 | B2 | 1/2017 | Fisher et al. |
| 9,553,553 | B2 | 1/2017 | Christoph |
| 9,560,460 | B2 | 1/2017 | Chaikin et al. |
| 9,571,923 | B2 | 2/2017 | Spillmann et al. |
| 9,575,971 | B2 | 2/2017 | Hampiholi |
| 9,584,887 | B2 | 2/2017 | Spillmann et al. |
| 9,591,395 | B2 | 3/2017 | Burgett et al. |
| 9,602,899 | B2 | 3/2017 | Li |
| 9,610,957 | B2 | 4/2017 | Baalu et al. |
| 9,615,170 | B2 | 4/2017 | Kirsch et al. |
| 9,661,428 | B2 | 5/2017 | Holladay et al. |
| 9,671,780 | B2 | 6/2017 | Griffiths et al. |
| 9,674,594 | B2 | 6/2017 | Li |
| 9,681,232 | B2 | 6/2017 | Millington et al. |
| 9,681,246 | B2 | 6/2017 | Horbach |
| 9,684,485 | B2 | 6/2017 | Vega-Zayas et al. |
| 9,686,626 | B2 | 6/2017 | Reuss |
| 9,703,324 | B2 | 7/2017 | Calatayud et al. |
| 9,711,131 | B2 | 7/2017 | Christoph |
| 9,715,365 | B2 | 7/2017 | Kusano |
| 9,716,939 | B2 | 7/2017 | Di Censo et al. |
| 9,723,410 | B2 | 8/2017 | Sell |
| 9,729,115 | B2 | 8/2017 | Kallai et al. |
| 9,730,359 | B2 | 8/2017 | Reilly et al. |
| 9,743,194 | B1 | 8/2017 | MacLean |
| 9,743,208 | B2 | 8/2017 | Oishi et al. |
| 9,748,647 | B2 | 8/2017 | Kallai et al. |
| D797,704 | S | 9/2017 | Fischer et al. |
| 9,756,424 | B2 | 9/2017 | Kallai et al. |
| 9,763,018 | B1 | 9/2017 | McPherson et al. |
| 9,780,739 | B2 | 10/2017 | Muench et al. |
| 9,787,274 | B2 | 10/2017 | Butts |
| 9,788,092 | B2 | 10/2017 | Rawls-Meehan et al. |
| 9,794,719 | B2 | 10/2017 | Chandran et al. |
| 9,794,720 | B1 | 10/2017 | Kadri |
| 9,798,936 | B2 | 10/2017 | Jiang et al. |
| 9,811,991 | B2 | 11/2017 | Di Censo et al. |
| 9,813,813 | B2 | 11/2017 | Pierfelice et al. |
| 9,815,404 | B2 | 11/2017 | Peachey et al. |
| 9,838,146 | B2 | 12/2017 | Chavez et al. |
| 9,853,758 | B1 | 12/2017 | Channegowda |
| 9,854,325 | B2 | 12/2017 | Gunther |
| 9,866,447 | B2 | 1/2018 | Millington et al. |
| 9,866,951 | B2 | 1/2018 | Trestain et al. |
| 9,872,119 | B2 | 1/2018 | Bush |
| 9,882,995 | B2 | 1/2018 | Van Erven et al. |
| 9,888,305 | B2 | 2/2018 | Prommersberger et al. |
| 9,888,319 | B2 | 2/2018 | Soulodre |
| 9,906,886 | B2 | 2/2018 | Burlingame |
| 9,942,637 | B2 | 4/2018 | Moro |
| 9,948,258 | B2 | 4/2018 | Marino, Jr. et al. |
| 9,955,246 | B2 | 4/2018 | Reese et al. |
| 9,955,253 | B1 | 4/2018 | Chavez |
| 9,961,480 | B2 | 5/2018 | Hutchings et al. |
| 9,965,245 | B2 | 5/2018 | Reilly et al. |
| 9,983,847 | B2 | 5/2018 | Lakkundi et al. |
| 9,992,565 | B2 | 6/2018 | Spillmann et al. |
| 9,992,577 | B2 | 6/2018 | Popken et al. |
| 10,001,969 | B2 | 6/2018 | Clayton et al. |
| 10,003,883 | B2 | 6/2018 | Moro |
| 10,007,481 | B2 | 6/2018 | Daly |
| 10,021,488 | B2 | 7/2018 | Stolz et al. |
| 10,024,712 | B2 | 7/2018 | Barjatia et al. |
| 10,028,056 | B2 | 7/2018 | Kallai et al. |
| 10,031,719 | B2 | 7/2018 | Barton et al. |
| 10,033,471 | B2 | 7/2018 | Ma et al. |
| 10,034,145 | B2 | 7/2018 | Yang et al. |
| 10,045,142 | B2 | 8/2018 | McPherson et al. |
| 10,048,930 | B1 | 8/2018 | Vega et al. |
| 10,051,399 | B2 | 8/2018 | Oishi et al. |
| 10,057,705 | B2 | 8/2018 | Brockmole et al. |
| 10,061,742 | B2 | 8/2018 | Lang et al. |
| 10,063,973 | B2 | 8/2018 | Mezzomo et al. |
| 10,065,561 | B1 | 9/2018 | Bastyr et al. |
| 10,097,939 | B2 | 10/2018 | Sheen et al. |
| 10,097,942 | B2 | 10/2018 | Griffiths et al. |
| 10,101,792 | B2 | 10/2018 | Calatayud et al. |
| 10,110,985 | B2 | 10/2018 | Meyer |
| 10,117,034 | B2 | 10/2018 | Millington et al. |
| 10,136,201 | B2 | 11/2018 | Fisher et al. |
| 10,136,218 | B2 | 11/2018 | Kallai et al. |
| 10,142,726 | B2 | 11/2018 | Oishi |
| 10,142,758 | B2 | 11/2018 | Sikora |
| 10,157,626 | B2 | 12/2018 | Nahman et al. |
| 10,194,233 | B2 | 1/2019 | Burgett et al. |
| 10,206,053 | B1 | 2/2019 | Welti |
| 10,225,656 | B1 | 3/2019 | Kratz et al. |
| 10,244,021 | B2 | 3/2019 | Chatterjee et al. |
| D845,925 | S | 4/2019 | Bellinghausen et al. |
| 10,255,912 | B2 | 4/2019 | Heber et al. |
| 10,256,536 | B2 | 4/2019 | Kallai et al. |
| 10,257,637 | B2 | 4/2019 | Di Censo et al. |
| 10,271,128 | B2 | 4/2019 | Li |
| 10,271,141 | B2 | 4/2019 | Glazer |
| 10,275,213 | B2 | 4/2019 | Daly |
| 10,284,158 | B2 | 5/2019 | Marino, Jr. et al. |
| 10,284,938 | B2 | 5/2019 | Spillmann et al. |
| 10,284,939 | B2 | 5/2019 | Radin et al. |
| 10,299,054 | B2 | 5/2019 | McPherson et al. |
| 10,299,055 | B2 | 5/2019 | Oishi et al. |
| 10,299,061 | B1 | 5/2019 | Sheen |
| 10,299,064 | B2 | 5/2019 | Di Censo et al. |
| 10,306,365 | B2 | 5/2019 | Kallai et al. |
| D851,057 | S | 6/2019 | Nam |
| 10,318,016 | B2 | 6/2019 | Di Censo et al. |

(56) References Cited

U.S. PATENT DOCUMENTS

| | | | |
|---|---|---|---|
| 10,324,683 | B2 | 6/2019 | Winton et al. |
| 10,327,061 | B2 | 6/2019 | Doy |
| 10,331,925 | B2 | 6/2019 | Georgallis |
| 10,332,504 | B1 | 6/2019 | Bastyr |
| 10,334,386 | B2 | 6/2019 | Reilly et al. |
| 10,341,763 | B2 | 7/2019 | Li et al. |
| 10,349,195 | B1 | 7/2019 | Button et al. |
| 10,362,385 | B1 | 7/2019 | Di Censo et al. |
| 10,365,886 | B2 | 7/2019 | Clayton et al. |
| 10,367,861 | B2 | 7/2019 | Shetty et al. |
| 10,368,164 | B2 | 7/2019 | Kirsch et al. |
| D856,980 | S | 8/2019 | Pedersen et al. |
| 10,375,466 | B2 | 8/2019 | Sheffield et al. |
| 10,375,468 | B2 | 8/2019 | Spillmann et al. |
| 10,377,486 | B2 | 8/2019 | Kratz et al. |
| 10,386,830 | B2 | 8/2019 | Griffiths et al. |
| 10,388,297 | B2 | 8/2019 | Di Censo et al. |
| 10,397,675 | B2 | 8/2019 | Kiang et al. |
| 10,412,517 | B2 | 9/2019 | Bush |
| 10,414,337 | B2 | 9/2019 | Kreifeldt et al. |
| 10,419,839 | B2 | 9/2019 | Ott et al. |
| 10,425,759 | B2 | 9/2019 | Pearson |
| 10,433,092 | B2 | 10/2019 | Chamness et al. |
| 10,439,578 | B1 | 10/2019 | Arunachalam |
| 10,440,465 | B2 | 10/2019 | Peace, Jr. et al. |
| 10,440,493 | B2 | 10/2019 | Trestain |
| 10,445,057 | B2 | 10/2019 | Vega et al. |
| 10,448,159 | B2 | 10/2019 | Kallai et al. |
| 2011/0286613 | A1 | 11/2011 | Lipsky et al. |
| 2015/0104037 | A1* | 4/2015 | Lee ..... H04R 27/00 381/80 |
| 2015/0237424 | A1 | 8/2015 | Wilker et al. |
| 2015/0287419 | A1* | 10/2015 | Chen ..... H04R 3/12 704/500 |
| 2017/0142508 | A1* | 5/2017 | Prommersberger ... H04R 1/026 |
| 2018/0146271 | A1 | 5/2018 | Tracy |

OTHER PUBLICATIONS

Written Opinion for PCT/US2019/045572, dated Nov. 14, 2019, 5 pages.

* cited by examiner

MODULAR SPEAKER SYSTEM

CROSS-REFERENCE TO RELATED APPLICATIONS

This application claims priority and benefit under 35 U.S.C. § 119(e) to U.S. Provisional Patent Application No. 62/715,750 titled "Surroundsound for Personal Electronic Device" and filed on Aug. 7, 2018, and priority to Chinese Utility Model Application No. 201821537933.4 titled "Modular Speaker Wireless Contacts Charging Unit" filed Sep. 20, 2018, Chinese Patent Application No. 201811098350.0 titled "Modular Speaker Wireless Contacts Charging Unit" filed Sep. 20, 2018, Chinese Utility Model Application No. 201821537876.X titled "Modular Stereo Speaker" filed Sep. 20, 2018, and Chinese Patent Application No. 201811098250.8 titled "Modular Stereo Speaker" filed Sep. 20, 2018, the content of each of which is hereby incorporated by reference herein in its entirety.

TECHNICAL FIELD

The present disclosure relates to speaker systems and more particularly to modular speaker systems configured to output sound in two or more arrangements.

BACKGROUND

Portable radio sets have been available since the 1920s, and readily carried transistor radios first became publicly available in the 1950s. These early portable entertainment systems typically include a single, i.e., monophonic speaker. In the 1970s, stereophonic "boomboxes" became popular. Some of these portable systems included more than two speakers exhibiting differential frequency response, but generally only two channels of audio information were produced. Additionally, in the 1970s, the first systems for reproducing quadraphonic (i.e., four channel) recordings became available in the consumer market. Generally speaking, these systems were not readily portable.

During the 1980s and 1990s, highly portable recorded music systems became available including Sony Walkman tape player and various compact disc players. These were followed in the late 1990s and early 2000s with various personal electronic devices capable of reproducing recorded music stored in integrated circuit memories.

SUMMARY

Despite the long-established demand suggested by the history of speaker systems, until the present invention, there was no effective solution providing a highly portable reconfigurable surround sound system adapted for use with personal electronic devices. The present invention provides a highly portable reconfigurable surround sound system adapted for use with portable electronic devices. An exemplary sound system includes two or more modular speakers that a user can orientate as desired. For example, in some embodiments the speaker modules can be physically connected to each other as a single compact item, facilitating easy transportation, storage, and/or display. In other embodiments, a user can physically separate the speakers in distance and arrange them in a room, in different rooms within a house, and/or in an exterior space (e.g., around a campsite, on a beach, in a backyard, etc.). By distributing the speakers around an area, the user can create an immersive surround sound effect. Advantageously, the exemplary modular speakers can be arranged and re-arranged at the user's choosing while continuously outputting sound. In other words, for example, the sound need not be interrupted while a user changes the configuration of the speakers in an area.

In one aspect, the disclosure features a modular speaker system including a plurality of wireless speaker modules configured to output sound in a first arrangement and in a second arrangement, in which the first arrangement is different from the second arrangement. In the first arrangement, at least one speaker module is in physical contact with at least one other speaker module, and in the second arrangement, the at least one speaker module is physically separated from the at least one other speaker module.

Various embodiments of the modular speaker system can include one or more of the following features. In the first arrangement, the at least one speaker module can be in electrical contact with the at least one other speaker module. In the first arrangement, the at least one speaker module can be in magnetic contact with the at least one other speaker module. Each speaker module can include a housing having at least one magnet. The at least one magnet can be configured to induce the magnetic contact between the at least one speaker module and the at least one other speaker module. The wireless speaker modules can include a primary speaker module and at least one secondary speaker module. The primary speaker module can be configured to receive audio data and wirelessly transmit the audio data to the at least one secondary speaker module, and the at least one secondary speaker module can be configured to receive the audio data from the primary speaker module and output sound corresponding to the audio data.

The primary speaker module can be configured to receive the audio data from a user device via a Bluetooth communication channel. The primary speaker module can be configured to wirelessly transmit the audio data to the at least one secondary module via a 2.4 GHz Wi-Fi communication channel or a 5.8 GHz Wi-Fi communication channel. The wireless speaker modules can include at least four wireless speaker modules. A first speaker module can be configured to provide a left-front sound channel; a second speaker module can be configured to provide a right-front sound channel; a third speaker module can be configured to provide a left-back sound channel; and a fourth speaker module is configured to provide a right-back sound channel. The audio data transmitted to the third and fourth speaker modules can have a delay in time relative to the audio data transmitted to the first and second speaker modules. The delay can be approximately 15 milliseconds.

In the first arrangement, the first speaker module, the second speaker module, the third speaker module, and the fourth speaker module can be configured to be arranged in any orientation with respect to each other. The modular speaker system can include a housing adapted to hold the plurality of wireless speaker modules in the first arrangement. The housing can encompass only a portion of each of the plurality of wireless speakers and leaves exposed a sound emitting portion of each of the plurality of wireless speakers. The housing can include a strap to facilitate carrying by a user.

In another aspect, the disclosure features a method of using a modular speaker system. The method can include the steps of providing a plurality of wireless speaker modules configured to output sound in a first arrangement and in a second arrangement, the first arrangement different from the second arrangement. The method can include arranging the wireless speaker modules in the first arrangement or in the second arrangement. In the first arrangement, at least one speaker module is in physical contact with at least one other speaker module, and in the second arrangement, the at least one speaker module is physically separated from the at least one other speaker module.

Various embodiments of the modular speaker system can include one or more of the following features. In the first arrangement, the at least one speaker module can be in electrical contact with the at least one other speaker module. In the first arrangement, the electrical contact can be accomplished by a magnetic contact between the at least one speaker module and the at least one other speaker module. Each speaker module can include a housing having at least one magnet. The at least one magnet can be configured to induce contact between the at least one speaker module and the at least one other speaker module. The wireless speaker modules can include a primary speaker module and at least one secondary speaker module. The method can further include receiving, by the primary speaker module, audio data; wirelessly transmitting, by the primary speaker module, the audio data to the at least one secondary speaker module; and receiving, by the at least one secondary speaker module, the audio data from the primary speaker module for outputting the sound in the first and second arrangements.

The receiving, by the primary speaker module, the audio data can include receiving, by the primary speaker module, the audio data from a user device via a Bluetooth communication channel. The wirelessly transmitting, by the primary speaker module, the audio data to the at least one secondary speaker module can include wirelessly transmitting, by the primary speaker module, the audio data to the at least one secondary speaker module via a 2.4 GHz Wi-Fi communication channel or a 5.8 GHz Wi-Fi communication channel. The wireless speaker modules can include at least four wireless speaker modules. A first speaker module can be configured to provide a left-front sound channel; a second speaker module is configured to provide a right-front sound channel; a third speaker module is configured to provide a left-back sound channel, and a fourth speaker module is configured to provide a right-back sound channel. The method can include transmitting to the third and fourth speaker modules the audio data with a delay in time relative to transmitting the audio data to the first and second speaker modules. The delay can be approximately 15 milliseconds.

These and other objects, along with advantages and features of the embodiments of the present disclosure, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Disclosed herein are various embodiments of highly portable reconfigurable modular speaker systems adapted for use with portable electronic devices (also referred to as user devices). In various exemplary embodiments, the system can be adapted and configured for operative communication with a personal electronic device (e.g., a smart phone, a smart watch, a tablet computer, a laptop computer, a notebook computer, etc.). In various embodiments, the one or more modules of the modular speaker system can be in communication with the personal electronic device via a communication channel (e.g., Bluetooth communication protocol). As referred to herein, a "primary" element (e.g., a module, component, controller, etc.) may be also known as a "master" element, and a "secondary" element (e.g., a module, component, controller, etc.) may be also known as a "slave" element.

Modular Speaker Systems

Figure 1A:
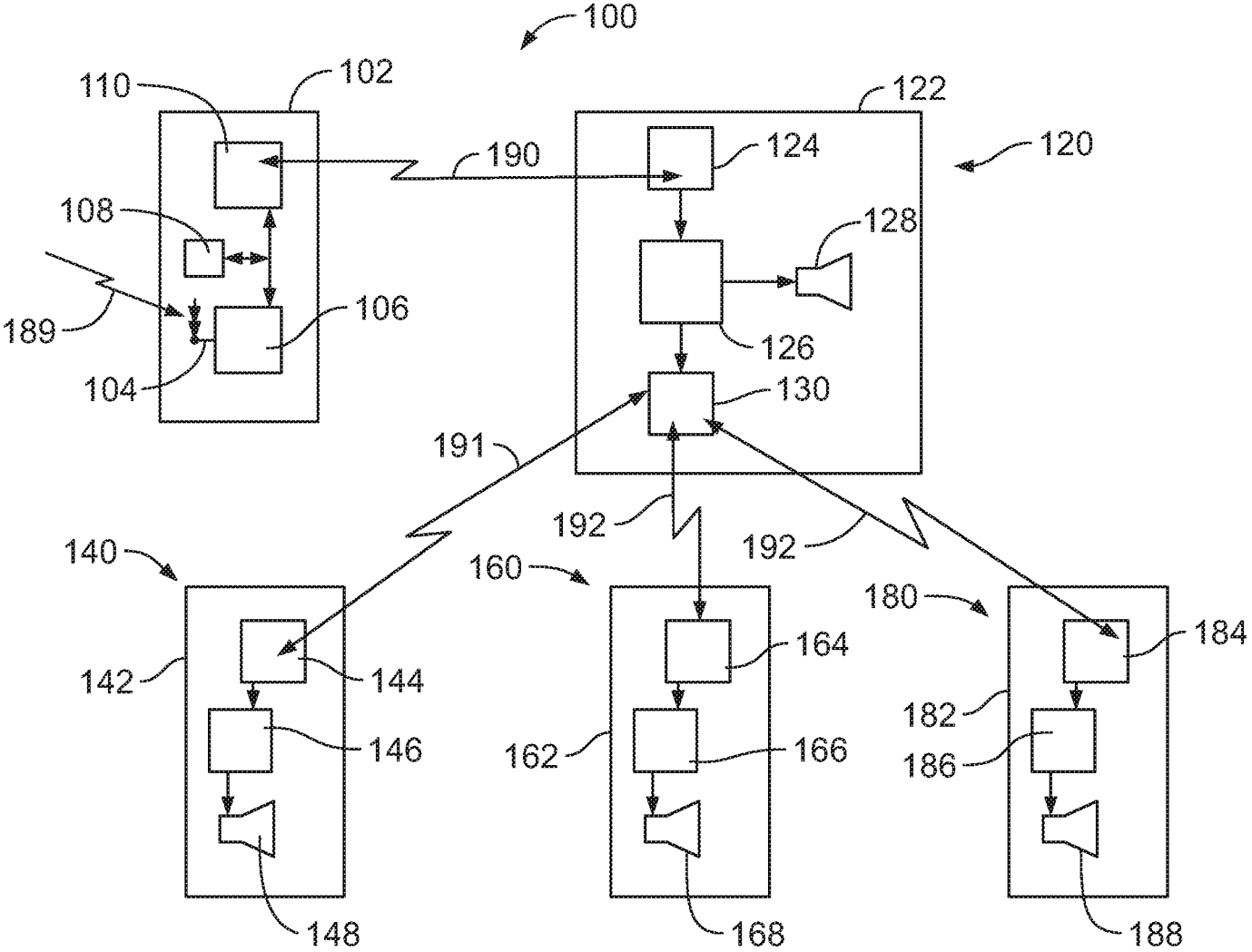
FIG. 1A is a schematic view of an overview of a surround sound system configured to communicate with a personal electronic device.

FIG. 1A shows, in schematic block diagram view, an overview of a surround sound system 100 configured to communicate with a personal electronic device 102, e.g., a smart phone. As is typical of a modern smart phone, the illustrated smart phone 102 includes a cell phone signal antenna 104.

The cell phone signal antenna 104 is signalingly coupled to a processing subsystem 106. The processing subsystem 106 typically provides digital codec and signal processing functions, user interface control, software processing and amplification, among other features, as would be known by one of skill in the art. The processing subsystem 106 is signalingly coupled within the personal electronic device 102 to an internal memory device 108, and to a communications subsystem 110 (e.g., a Bluetooth communication subsystem 110, although other communication protocols are possible and contemplated).

The Bluetooth communication subsystem 110 can provide functionality including signal processing, amplification, and telecommunications and typically would include an antenna configured as an antenna adapted to communicate Bluetooth communication signals.

The exemplary surround sound system 100 includes a primary module 120 having a housing 122. Within the housing, is disposed a Bluetooth communication subsystem 124 coupled to a processing and amplification subsystem 126. The processing and amplification subsystem 126 is operatively coupled to an audio speaker device 128 and to a communication subsystem 130.

In one exemplary embodiment, the communication subsystem 130 is arranged to provide a 2.4 GHz radio communication signal and can generate and modulate the carrier signal. The subsystem 130 can include an appropriate antenna device for transmitting and/or receiving communication signals.

The exemplary surround sound system 100 can include a plurality of secondary speaker modules, (e.g., modules 140, 160, and 180). The speaker modules 140, 160, and 180 can be disposed within respective housings 142, 162, and 182. Each secondary module includes a respective communication subsystem, e.g., 144, 164, and 184. The modules' communication subsystems 144, 164, and 184 are operatively coupled to respective amplifier devices, e.g., 146, 166, 186. These amplifier devices are in turn coupled to respective audio speakers, e.g., 148, 168, 188.

In certain exemplary modes of operation, a personal electronic device 102 can receive electromagnetic signal 189 at antenna 104. The electromagnetic signal will encode data representing, for example, an audio entertainment program. Processing subsystem 106 receives further data corresponding to the audio entertainment program and encode the information of that data signal in memory device 108.

In other embodiments of the invention, data is encoded in memory device 108 after having been received directly by, for example, a hardwired connection, or by other programming needs during, for example, manufacturing or preprocessing of the personal electronic device 102, or of the memory device 108.

Data from the memory 108 is received at the Bluetooth communication subsystem 110 and broadcast as an electromagnetic signal 190 according to, for example, a Bluetooth protocol.

This broadcast signal is received by Bluetooth communication subsystem 124 which decodes the signal and provides corresponding data to the processing and amplification subsystem 126. The processing and amplification subsystem 126 provides a digital to analog conversion based on the received data, and produces an analog electrical audio signal which drives the primary module audio speaker device 128.

In addition, the processing and amplification subsystem forwards an analog electrical audio signal to the further communication subsystem 130 which produces a local analog radio signal that is received by respective communications systems, e.g., 144, 164, and 184.

In other embodiments, the processing and amplification subsystem 126 forwards the digital data to the communication subsystem 130 which executes a digital radio communication protocol with communication systems, e.g., 144, 164, 184, configured as digital communication devices.

The signals received at communication systems 144, 164, and 184 are amplified by respective amplifier devices, e.g., 146, 166, and 186 and transduced by audio speaker devices, e.g., 148, 168, and 188, to provide an audible entertainment program within an environment of the system 100.

It will be appreciated by one of skill in the art that the data underlying this audio program can be configured at the personal electronic device 102, the primary module 120, or at the secondary modules 140, 160, 182 produce a surround sound or quadraphonic effect. Accordingly, for example, processing and amplification system 126 can, in certain embodiments, be arranged and configured to provide individualized signals, e.g., 191, 192, and 193, to the individual secondary modules 140, 160, and/or 180. These individualized signals may be transmitted based on a frequency division multiplexing protocol, a time division multiplexing protocol, or any other technical arrangement appropriate to achieve the surround sound effect.

It will be appreciated by one of skill in the art that the foregoing description is schematic and omits certain features including, for example, battery or other energy storage subsystems which are described, for example, below.

Communication Systems

Figure 1B:
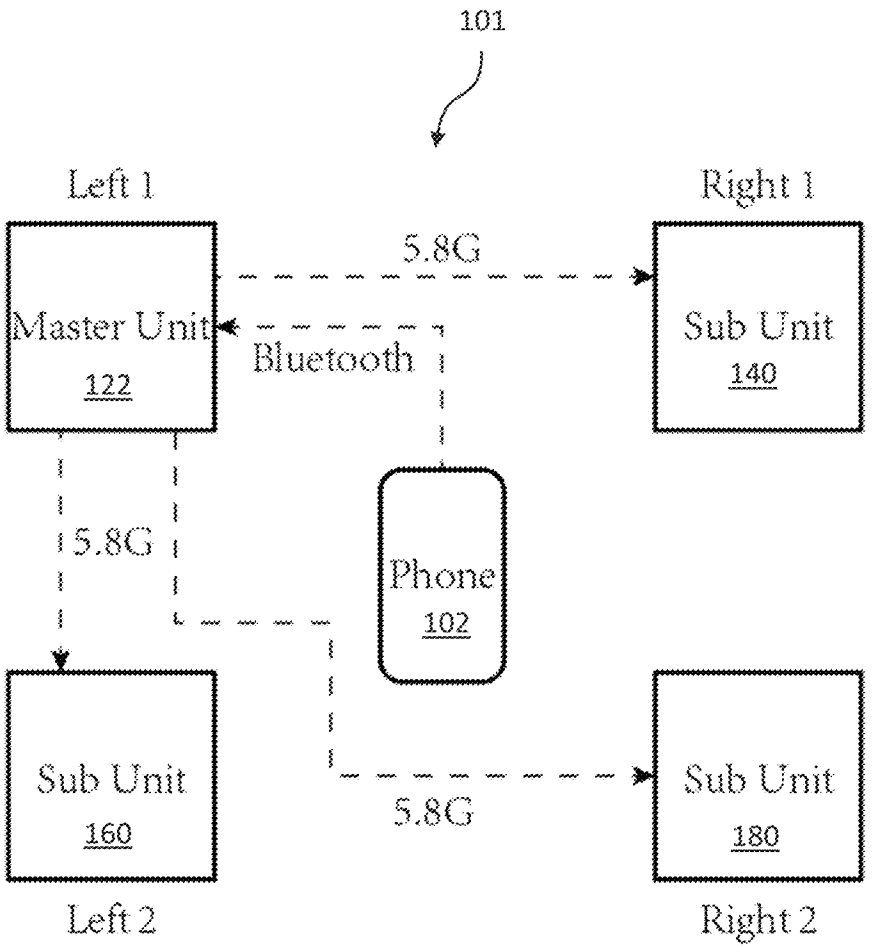
FIG. 1B is a diagram of a modular speaker system in which a primary module is configured to communicate with a user device (and a plurality of secondary units.

In various embodiments, the modular speaker system can be configured with communication capability over radio, Wi-Fi, Bluetooth connection, etc. For example, the primary module of the speaker system may communicate with one or more secondary module over 2.4 GHz Wi-Fi communication channel or a 5.8 GHz Wi-Fi communication channel. For example, each module speaker of the system 100 can include a 5.8 GHz Wi-Fi chip configured to pair one module of the system to another module of the system. In a particular embodiment, the primary module is configured to communicate with each secondary module over the 5.8 GHz frequency band. In some cases, Wi-Fi communication may provide for a greater range as compared to Bluetooth communication thereby enabling greater distance between the primary module and the secondary module(s). FIG. 1B is a diagram illustrating a modular speaker system 101 in which a primary module 122 is configured to communicate with a user device 102 (e.g., smart phone) and a plurality of secondary units 140, 160, and 180.

In the exemplary configuration of FIG. 1B, there are four (4) speaker modules (one primary and 3 secondary modules) corresponding to sound channels emulating a first left side (labelled "Left 1"), a second left side (labelled "Left 2), a first right side (labelled "Right 1"), and a second right side (labelled "Right 2"). In this example, the primary module 122 corresponds to the Left 1 sound channel; however, the primary module 122 may correspond to any of the sound channels described herein. In some embodiments, the primary module 122 transmits the audio data to the secondary modules 140, 160, and 180 such that there is a fixed delay in outputting the sound. Specifically, the sound from module 160 (Left 2) and module 180 (Right 2) has a delay in time with sound from module 122 (Left 1) and module 140 (Right 1). In general, any advantageous time delay is possible, e.g., in a range from 1-100 milliseconds, in a range from 5-75 milliseconds, in a range from 7-50 milliseconds, in a range from 9-25 milliseconds, and in a range from 11-20 milliseconds). In some embodiments, the delay is approximately 15 milliseconds.

In some embodiments, by arranging the speaker modules around the user, the four speaker modules can create a surround sound experience for the user positioned approximately in between the four modules 122, 140, 260, and 180 (e.g., at the relative position of the user device 102).

In various embodiments, the primary module 122 receives audio data from a user device 102 via a Bluetooth communication channel. The primary module 122 then transmits the data to each of the secondary modules 140, 160, and 180 via a 5.8 GHz Wi-Fi communication channel. Advantageously, the secondary modules 140, 160, and 180 can be "prepaired" to the primary module 122 such that individual communication channels do not need to be manually established by the user to start using the speaker system. Conventionally, to set up an "ad hoc" surround sound system using individual unpaired wireless speakers, a user would manually need to establish a communication channel from (or "pair") one speaker to another speaker. This can be a cumbersome experience because the speakers are not configured to interoperate with other speakers and because pairing between greater numbers of speakers take significant time at the beginning. Therefore, the exemplary systems and methods described herein have the benefit of saving time and effort for the user, thereby generally creating a better user experience. In some embodiments, the user can selectively turn on or off any one or more secondary modules in the modular speaker system without interrupting the sound experience from the remaining module(s) or having to manually pair the secondary module back to the remaining module(s). In other words, a secondary module can automatically connect to the one or more modules of the modular speaker system. This can further creates a more versatile and customizable experience for the user.

Module Housings

Figure 2:
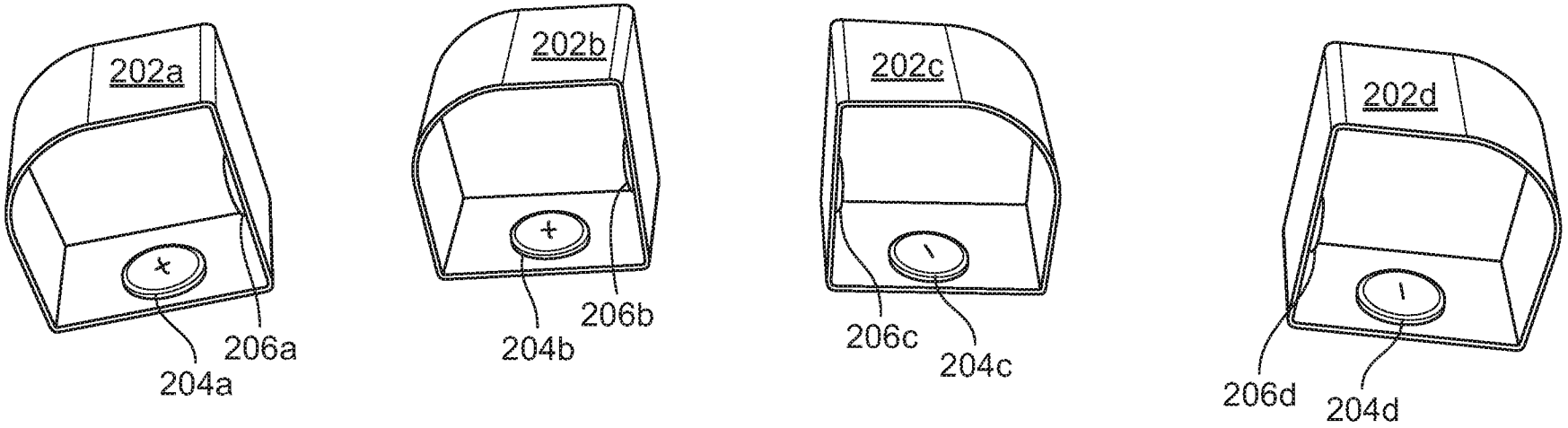
FIG. 2 is a perspective view of four speaker housings, of which one speaker housing houses a primary module components while the other speaker housings house secondary module components.

In certain embodiments, the system 100 includes a plurality of speaker modules, each having a respective housing. FIG. 2 illustrates four speaker housings 202*a*, 202*b*, 202*c*, and 202*d* (collectively referred to as housing(s) 202), of which one speaker housing houses a primary module components while the other speaker housings house secondary module components. In some embodiments, each housing 202 can include one or more coupling devices. Examples of coupling devices can include magnets (e.g., rare earth magnets), latches, or other mechanical means of removably coupling one housing to at least one other housing. For example, housing 202*a* includes magnets 204*a* and 206*a*; housing 202*b* includes magnets 204*b* and 206*b*; housing 202*c* includes magnets 204*c* and 206*c*; and housing 202*d* includes 204*d* and 206*d*. Magnets 204*a*, 204*b*, 204*c*, and 204*d* are collectively referred to as magnet(s) 204; magnets 206*a*, 206*b*, 206*c*, and 206*d* are collectively referred to as magnet(s) 206.

Figure 3B:
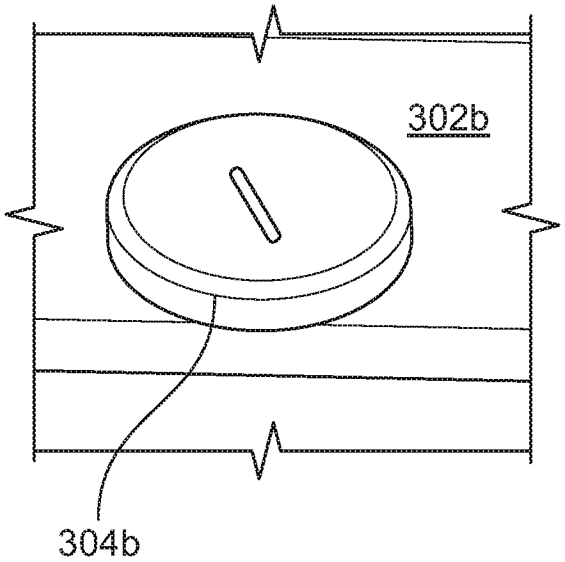
FIG. 3B is an enlarged view of another interior portion of an exemplary housing of a speaker module.
Figure 3A:
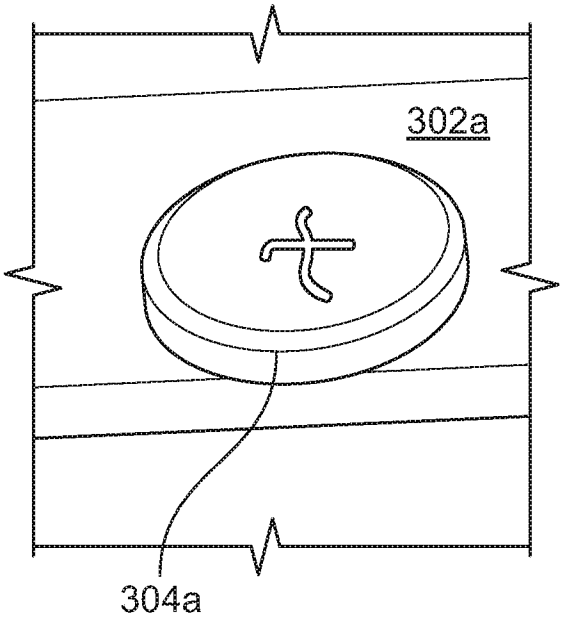
FIG. 3A is an enlarged view of an interior portion of an exemplary housing of a speaker module.
Figure 3D:
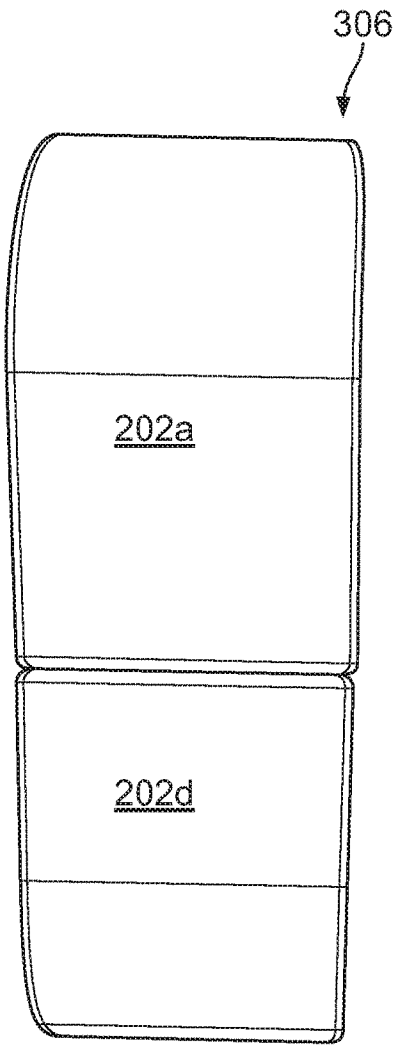
FIG. 3D is a side view of the exemplary arrangement of FIG. 3C.
Figure 3C:
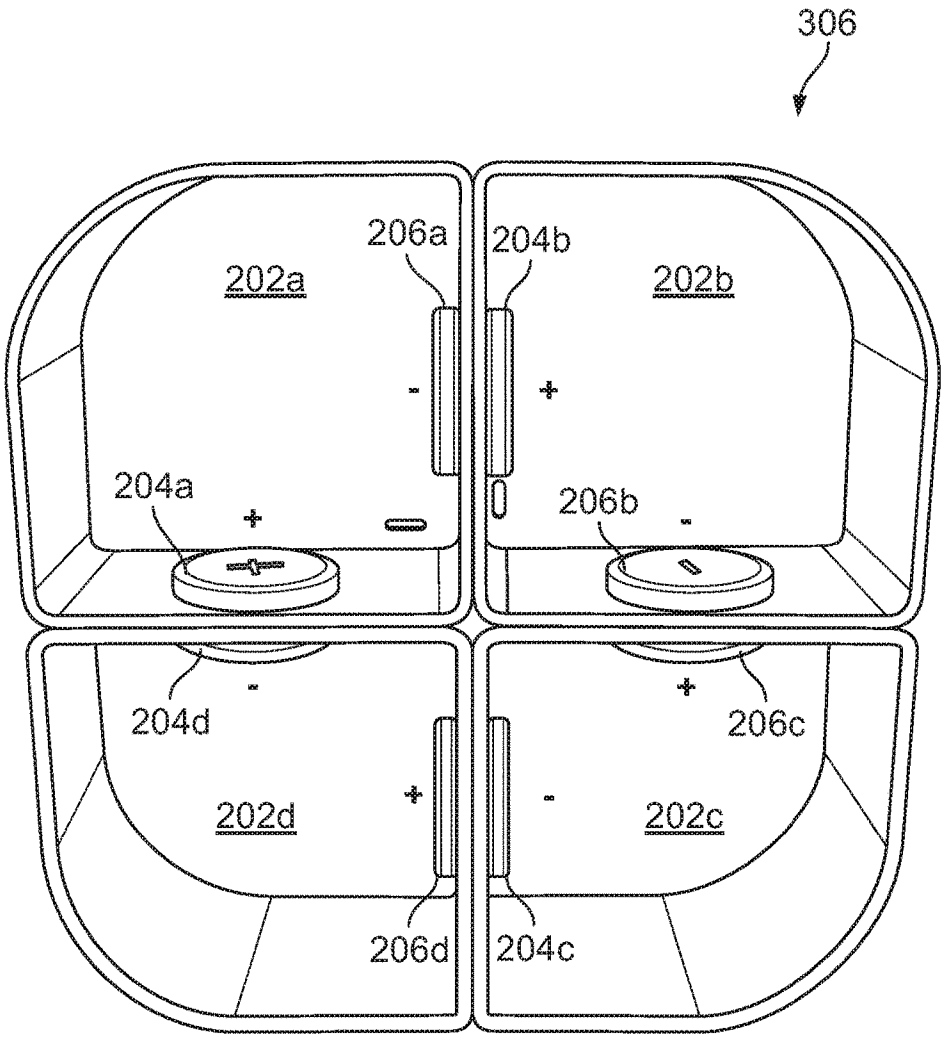
FIG. 3C is a perspective view of the exemplary housings of FIG. 2 in an exemplary arrangement.

FIG. 3A is an enlarged view of an interior portion 302*a* of an exemplary housing 202 including two coupling devices 204. FIG. 3B is an enlarged view of another interior portion 302*b* of an exemplary housing 202. The exemplary housing interior portion 302*a* includes a first magnet 304*a* configured such that its North Pole is oriented inward to the interior 302*a* of the housing 202 and a second magnet configured such that its North Pole is oriented outward from of the housing. The coupling devices (e.g., magnets 204 and 206) are arranged and configured to enable the housings 202 to be coupled to one another. FIG. 3C illustrates an exemplary arrangement 306 of the housings 202, in which two housings 202*a*, 202*b* are combined with housings 202*c*, 202*d* to form a rectangular shape. In some embodiments, the housings 202 are combined together via the magnets 204, 206, as described herein. FIG. 3D is a side view of the arrangement 306.

In various embodiments, the exemplary housings are arranged and configured to support respective transducers (e.g., audio speakers). In certain embodiments, the respective housings are arranged such that the sound signals can share a common phase when the housing modules are coupled to one another. In certain embodiments, speaker phase may be adjusted to different phase relationships when the housing modules are separated from one another.

Module Components

In certain embodiments, each of the four modules are identical, both in external form and in contents, to the other three modules. In other embodiments of the invention, one module is a primary module and the other modules will be secondary modules. The primary housing of the primary module may include Bluetooth circuitry arranged and configured for communication with a personal electronic device, or other audio signal source, and additional communication circuitry for wireless communication with the three secondary modules. In some embodiments, the primary module differs from the secondary modules in that it includes components for receiving a charge from an external source (e.g., a battery pack, wall outlet, etc.).

Figure 4A:
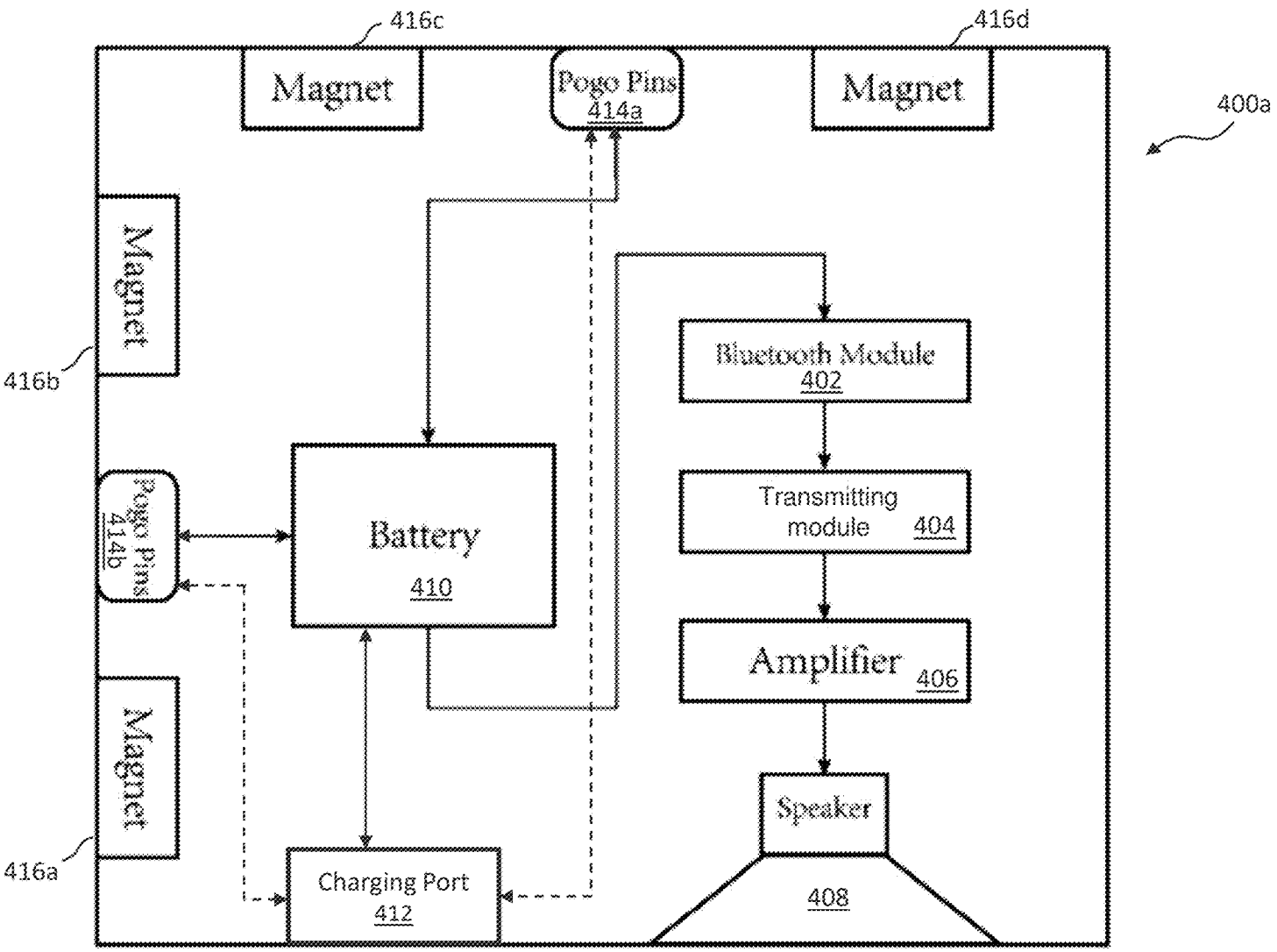
FIG. 4A is a schematic view of components of an exemplary primary speaker module.

FIG. 4A is a schematic view of components of an exemplary primary speaker module 400*a*. As described above, the primary module 400*a* (e.g., primary module 122) can include a Bluetooth module 402 for communicating with a user device 102, a transmitting module 404 for communicating with secondary modules (e.g., module 140, 160, and 180), and an amplifier 406 coupled to a speaker 408 for outputting sound according to the audio data. The primary module 400 can also include energy storage 410 (e.g., a battery, supercapacitor, etc.) configured to provide electrical power to components 402, 404, 406, and/or 408. For example, the battery 410 may be a built-in 2000 mAh Lithium ion battery having an 8-hour capacity and configured to fully charge within 2 hours. In some embodiments, the primary module 400*a* includes a charging port 412 for receiving power via an electrical outlet. The port 412 may be a USB connection (e.g., via a USB-C power cable), a customized port, etc. In the exemplary embodiment, the battery 410 is electrically coupled to connection ports 414*a* and 414*b* for electrically connecting to adjacent speaker modules (e.g., secondary modules 140, 160, or 180) (see also discussion above under heading "Module Housings"). In some embodiments, the connection ports 414*a*, 414*b* can be a conductive connection (e.g., via Pogo pins). In some embodiments, the magnet(s) 416*a*, 416*b*, 416*c*, and/or 416*d* (collectively referred to as 416) can enable adjacent modules to be combined. In this "combination" mode, the primary module 400*a* can provide an electrical pathway for the secondary modules to be charged. In some embodiments, the charging port 412 may be directly coupled (bypassing battery 410) to the connection ports 414*a*, 414*b* for charging adjacent modules.

Figure 4B:
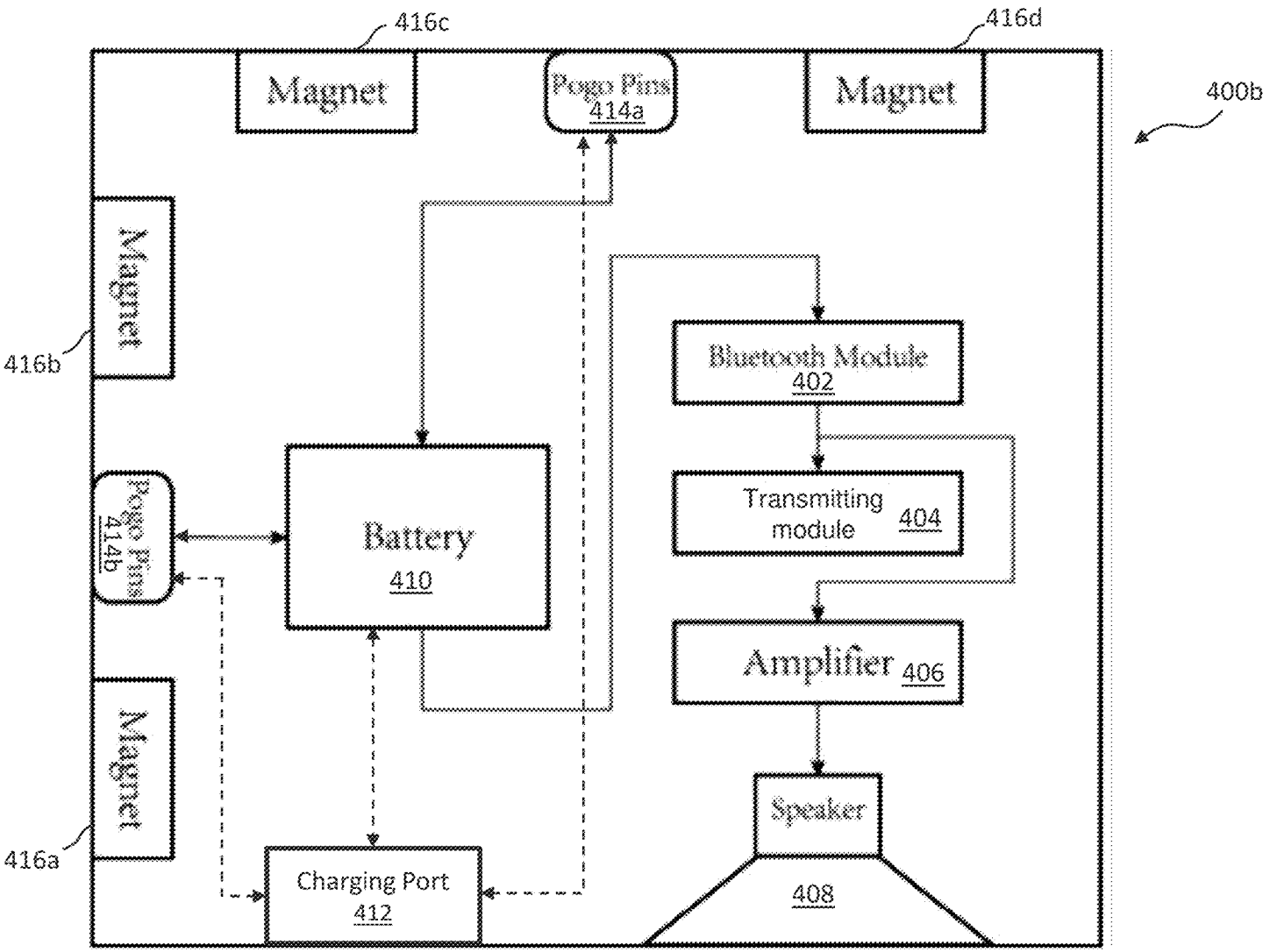
FIG. 4B is a schematic view of components of another exemplary primary speaker module.

FIG. 4B is a schematic view of components of another exemplary primary speaker module 400*b*. In this alternative configuration, the primary module 400*b* (e.g., primary module 122) includes communication paths from the Bluetooth module 402 separately to the transmitting module 404 and to the amplifier 406.

Figure 4C:
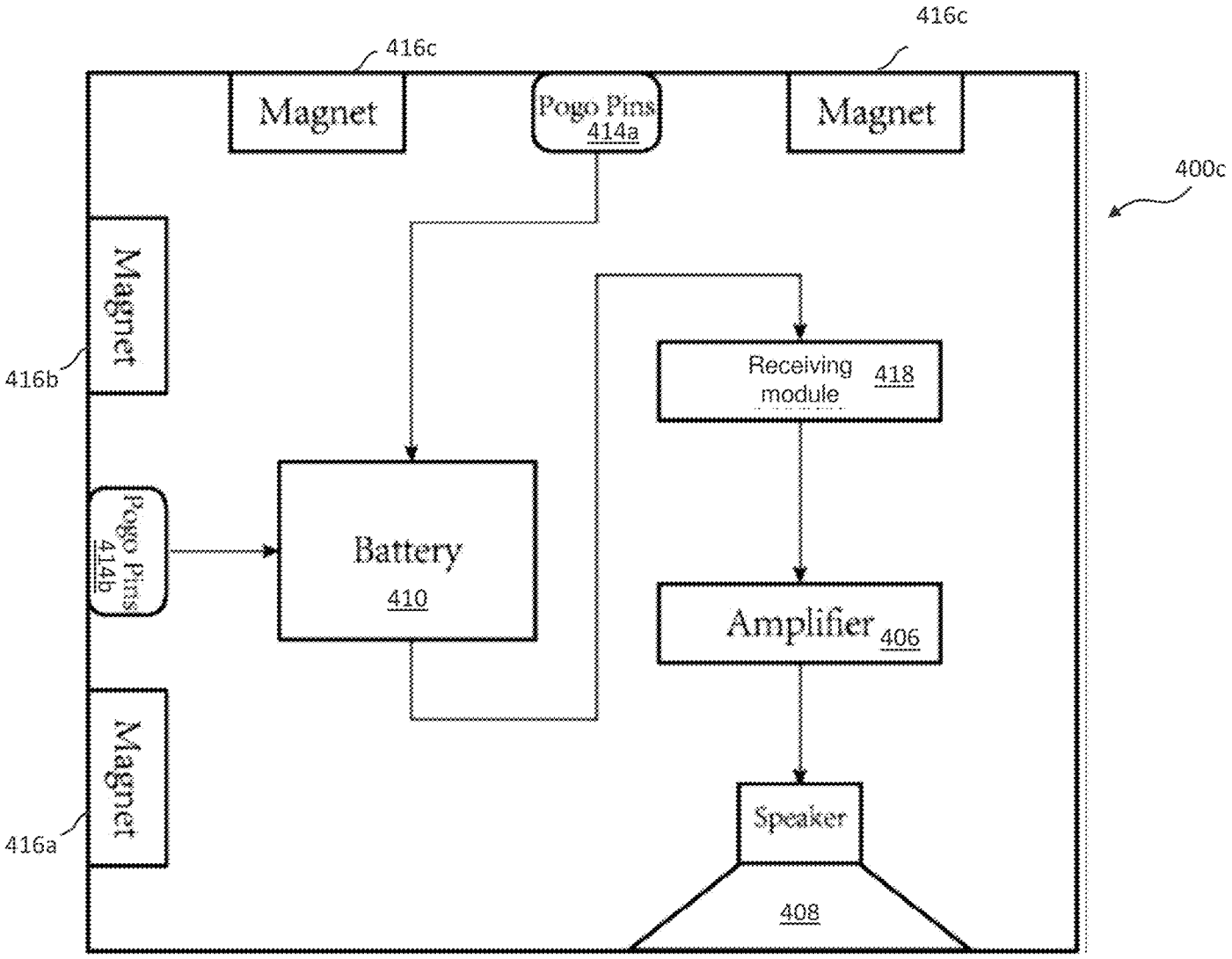
FIG. 4C is a schematic view of components of an exemplary secondary speaker module.

FIG. 4C is a schematic view of components of an exemplary secondary speaker module 400*c*. The exemplary secondary module 400*c* includes a receiving module 418 for receiving audio data from the primary module (e.g., 400*a* or 400*b*) coupled to an amplifier 406 and speaker 408 for outputting sound according to the audio data. The receiving module 418 is coupled to a battery 410 for its power needs. The battery 410 can be coupled to each of the connection ports 414*a* and 414*b* for charging purposes. As described above, the primary module 400*a*, 400*b* can be connected to an external power source via the charging port 412. This power can be ultimately delivered to each of the secondary module(a) 400*a* via the connection ports 414*a*, 414*b*. The secondary module 400*c* can include magnets 416 to enable combining with adjacent modules.

Figure 5A:
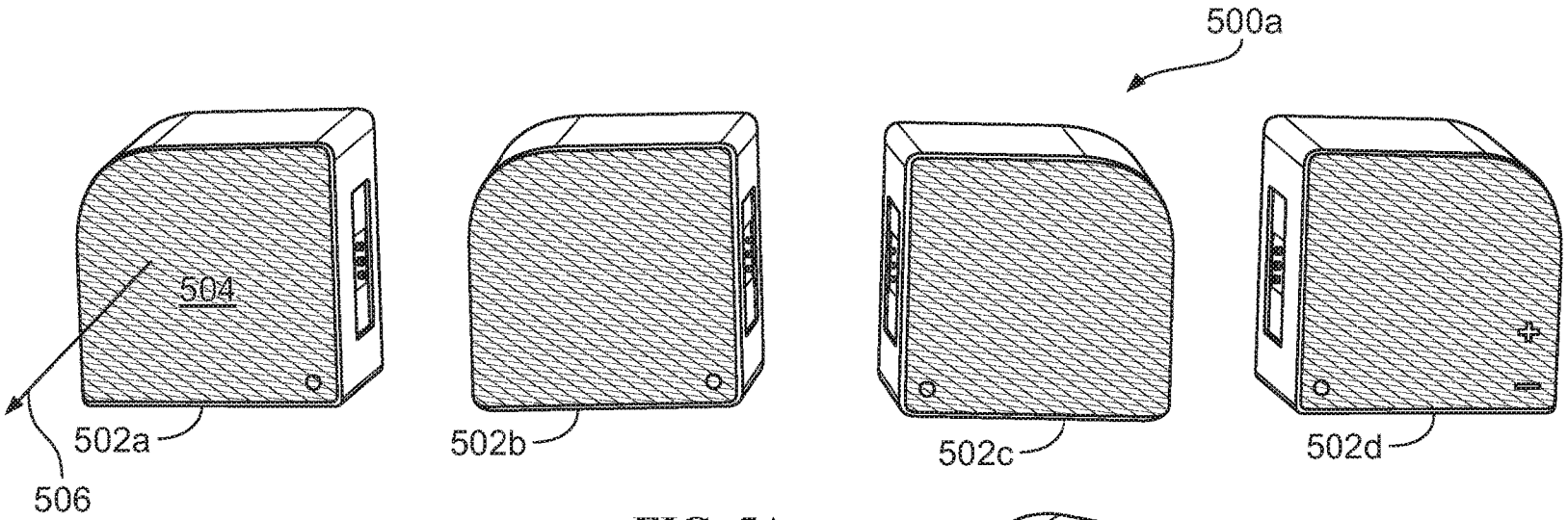
FIG. 5A is a perspective view of the exterior of exemplary speaker modules in "separate" mode.

FIG. 5A is a perspective view of the exterior of exemplary speaker modules in "separate" mode 500*a*. The exemplary modules 502*a*, 502*b*, 502*c*, and 502*d* (collectively referred to as 502) are distributed in space such that the speaker (not shown) under surface 504 can project sound outward 506. However, modules 502 can be distributed in any arrangement in space. For example, the secondary modules 502*b*, 502*c*, 502*d* can be arranged in nearly endless configurations in space as long as they are within communication range of the primary module 502*a* (so as to continue projecting sound based on the audio data provided by the primary module). For example, each module 502 has dimensions of approximately 80 mm by approximately 80 mm by approximately 48 mm.

Figure 5B:
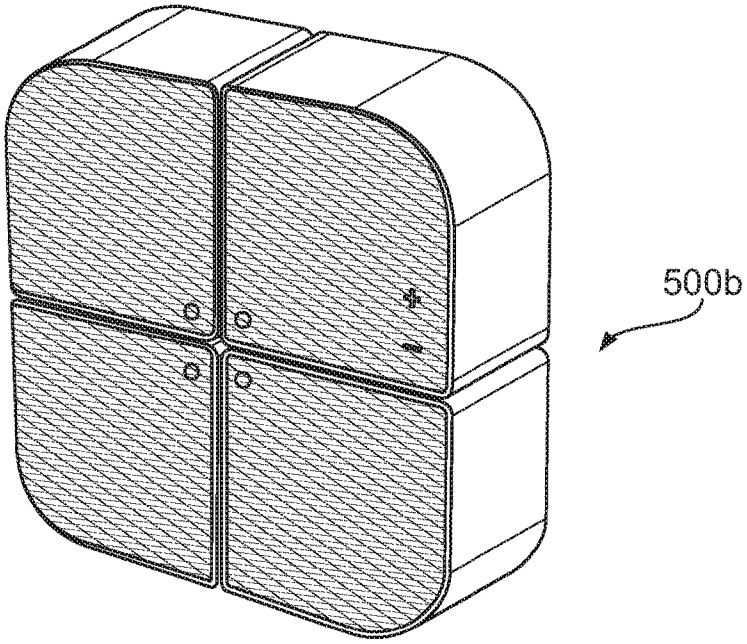
FIG. 5B is a perspective view of the exterior of speaker modules in "combination" mode.

FIG. 5B is a perspective view of the exterior of modules 502 in "combination" mode 500*b*. In this mode, the modules 502 are arranged so as to contact one another. Such an arrangement can enable to modules 502 to physically operate as a single unit, which can be advantageous for transportation, storage, and/or display purposes. In some embodiments, the arrangement of the modules in combination mode 502 can be orientation agnostic; meaning that any module 502 can occupy any quadrant of the combined speaker. In various embodiments, module 502*a* can be located in the top left, bottom left, top right, or bottom right quadrant; module 502*b* can be located in the top left, bottom left, top right, or bottom right quadrant; module 502*c* can be located in the top left, bottom left, top right, or bottom right quadrant; and/or quadrant 502*d* can be located in the top left, bottom left, top right, or bottom right quadrant. In other embodiments, one or more of the modules have a predetermined orientation. As discussed above, magnets within the housings of the modules 502 can enable the physical connection between the modules 502 in combination mode 500*b*. In some instances, the magnetic coupling also enables charging; either because the magnetic connections themselves also perform a charging function or because the magnetic connections facilitate connection of a separate electrical connection. Referring to the above example, the combination of the modules 502 yields dimensions of approximately 160 mm by approximately 160 mm by approximately 48 mm.

Figure 6:
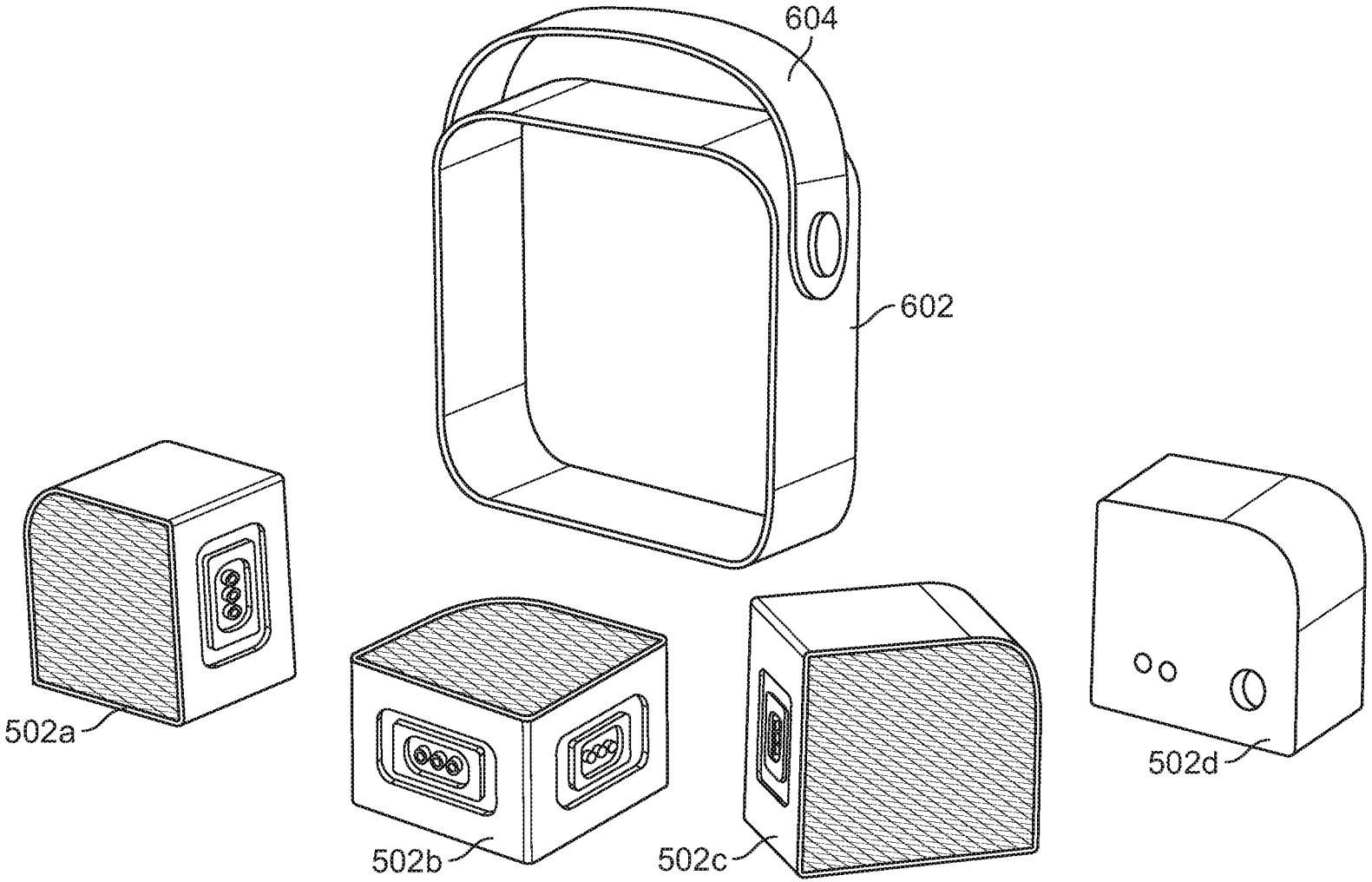
FIG. 6 is a perspective view of an exemplary housing for speaker modules.

FIG. 6 illustrates an exemplary housing 602 for the modules 502. The housing 602 can be used to mount and/or transport the individual modules. In certain embodiments, the housing 602 can facilitate charging of the modules by holding the modules together in combination mode 500*b*. The housing 602 can include a handle or strap 604 to facilitate carrying by a user. In some embodiments, the housing 602 has openings such that the sound emitting portions within the modules 502 can be exposed (and therefore enable sound to be better projected in the area surrounding the speaker system).

Figure 7B:
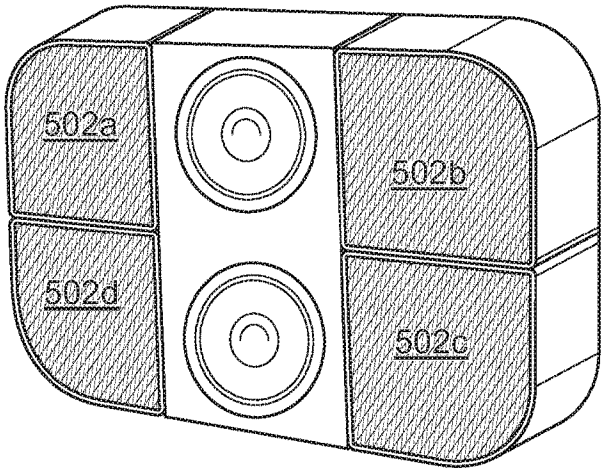
FIGS. 7A-7B are perspective views of an exemplary modular speaker system, including a subwoofer type of speaker module, in separate mode and combination mode, respectively.
Figure 7A:
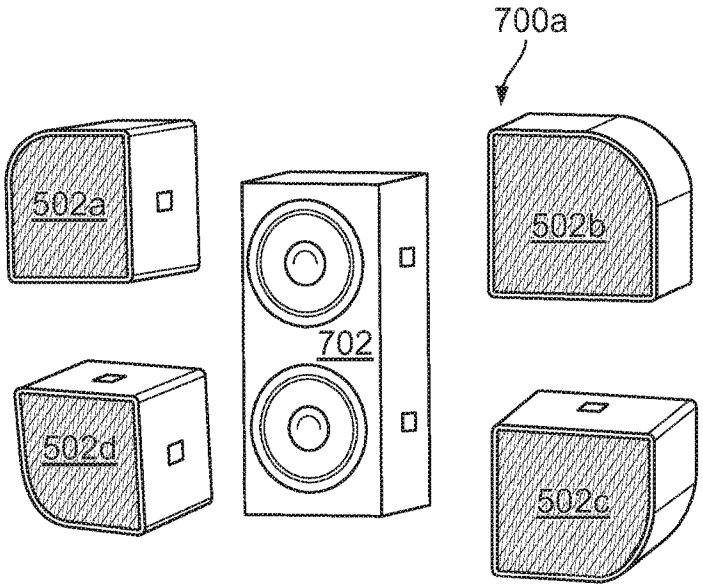

FIGS. 7A-7B illustrate an alternative embodiment of the modular speaker system, including an additional type of speaker module 702, in separate mode 700*a* and combination mode 700*b*, respectively. The system includes modules 502 (as described above) configured to couple to a subwoofer-type module 702. The module 702 can include components similar to those described for each of the speaker modules, including a battery, connection pins, magnets, speaker, amplifier, etc. The connection pins of the subwoofer module 702 enable electrical connection to the modules 502.

Terminology

The phraseology and terminology used herein is for the purpose of description and should not be regarded as limiting.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0.1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

What is claimed is:

1. A modular speaker system comprising:

a plurality of wireless speaker modules configured to output sound in a first arrangement and in a second arrangement, the first arrangement different from the second arrangement, wherein each speaker module has an outer profile and an inner profile, the outer profile being different from the inner profile, and wherein:

in the first arrangement, at least one speaker module is in physical contact with at least one other speaker module such that the inner profile of the at least one speaker module is in contact with the at least one other speaker module, and in the second arrangement, the at least one speaker module is physically separated from the at least one other speaker module; and a housing adapted to removably interface with the outer profile of each speaker and hold the plurality of wireless speaker modules in the first arrangement to facilitate carrying by a user.

2. The speaker system of claim 1, wherein, in the first arrangement, the at least one speaker module is in electrical contact with the at least one other speaker module.

3. The speaker system of claim 1, wherein, in the first arrangement, the at least one speaker module is in magnetic contact with the at least one other speaker module.

4. The speaker system of claim 3, wherein each speaker module comprises a housing having at least one magnet, the at least one magnet configured to induce the magnetic contact between the at least one speaker module and the at least one other speaker module.

5. The speaker system of claim 1, wherein the wireless speaker modules comprise a primary speaker module and at least one secondary speaker module, wherein:

the primary speaker module is configured to receive audio data and wirelessly transmit the audio data to the at least one secondary speaker module, and the at least one secondary speaker module is configured to receive the audio data from the primary speaker module and output sound corresponding to the audio data.

6. The speaker system of claim 5, wherein the primary speaker module is configured to receive the audio data from a user device via a Bluetooth communication channel.

7. The speaker system of claim 5, wherein the primary speaker module is configured to wirelessly transmit the audio data to the at least one secondary module via a 2.4 GHz Wi-Fi communication channel or a 5.8 GHz Wi-Fi communication channel.

8. The speaker system of claim 1, wherein the wireless speaker modules comprise at least four wireless speaker modules.

9. The speaker system of claim 8, wherein:

a first speaker module is configured to provide a left-front sound channel, a second speaker module is configured to provide a right-front sound channel, a third speaker module is configured to provide a left-back sound channel, and a fourth speaker module is configured to provide a right-back sound channel; and wherein audio data transmitted to the third and fourth speaker modules has a delay in time relative to the audio data transmitted to the first and second speaker modules.

10. The speaker system of claim 9, wherein the delay is approximately 15 milliseconds.

11. The speaker system of claim 8, wherein in the first arrangement the first speaker module, the second speaker module, the third speaker module, and the fourth speaker module are configured to be arranged in any orientation with respect to each other.

12. The speaker system of claim 1, wherein the housing encompasses only a portion of each of the plurality of wireless speakers and leaves exposed a sound emitting portion of each of the plurality of wireless speakers.

13. The speaker system of claim 1, wherein the housing comprises a strap to facilitate carrying by the user.

14. A method of using a modular speaker system, the method comprising the steps of:

providing a plurality of wireless speaker modules configured to output sound in a first arrangement and in a second arrangement, the first arrangement different from the second arrangement, wherein each speaker module having an outer profile and an inner profile, the outer profile being different from the inner profile; and arranging the wireless speaker modules in the first arrangement or in the second arrangement, wherein:

in the first arrangement, at least one speaker module is in physical contact with at least one other speaker module such that the inner profile of the at least one speaker module is in contact with the at least one other speaker module, and in the second arrangement, the at least one speaker module is physically separated from the at least one other speaker module; and providing a housing adapted to removably interface with the outer profile of each speaker and hold the plurality of wireless speaker modules in the first arrangement to facilitate carrying by a user.

15. The method of claim 14, wherein, in the first arrangement, the at least one speaker module is in electrical contact with the at least one other speaker module.

16. The method of claim 15, wherein, in the first arrangement, the electrical contact is accomplished by a magnetic contact between the at least one speaker module and the at least one other speaker module.

17. The method of claim 16, wherein each speaker module comprises a housing having at least one magnet, the at least one magnet configured to induce contact between the at least one speaker module and the at least one other speaker module.

18. The method of claim 14, wherein the wireless speaker modules comprise a primary speaker module and at least one secondary speaker module, the method further comprising:

receiving, by the primary speaker module, audio data;

wirelessly transmitting, by the primary speaker module, the audio data to the at least one secondary speaker module; and receiving, by the at least one secondary speaker module, the audio data from the primary speaker module for outputting the sound in the first and second arrangements.

19. The method of claim 18, wherein receiving, by the primary speaker module, the audio data comprises:

receiving, by the primary speaker module, the audio data from a user device via a Bluetooth communication channel.

20. The method of claim 18, wherein wirelessly transmitting, by the primary speaker module, the audio data to the at least one secondary speaker module comprises:

wirelessly transmitting, by the primary speaker module, the audio data to the at least one secondary speaker module via a 2.4 GHz Wi-Fi communication channel or a 5.8 GHz Wi-Fi communication channel.

21. The method of claim 14, wherein the wireless speaker modules comprise at least four wireless speaker modules.

22. The method of claim 21, wherein:

a first speaker module is configured to provide a left-front sound channel, a second speaker module is configured to provide a right-front sound channel, a third speaker module is configured to provide a left-back sound channel, and a fourth speaker module is configured to provide a right-back sound channel; the method comprising:

transmitting to the third and fourth speaker modules the audio data with a delay in time relative to transmitting the audio data to the first and second speaker modules.

23. The method of claim 21, wherein the delay is approximately 15 milliseconds.

24. The method of claim 14, wherein a curve of the outer profile has an arc radius greater than an arc radius of a curve of the inner profile.

25. The method of claim 24, wherein the plurality of wireless speaker modules comprise four speaker modules and wherein, in the first arrangement, each of the four speaker modules is adapted to occupy any quadrant of a combination of the four speaker modules.

26. The speaker system of claim 1, wherein a curve of the outer profile has an arc radius greater than an arc radius of a curve of the inner profile.

27. The speaker system of claim 26, wherein the plurality of wireless speaker modules comprise four speaker modules and wherein, in the first arrangement, each of the four speaker modules is adapted to occupy any quadrant of a combination of the four speaker modules.

* * * * *